US006056465A

United States Patent [19]

Kuo

[11] Patent Number: 6,056,465

[45] Date of Patent: May 2, 2000

[54] LIPSTICK CASE

[76] Inventor: Chen-Hui Kuo, No. 191, Lu Tung Road, Ting Tsuo Li, Lu Kang Township, Chang Hua Hsien, Taiwan

[21] Appl. No.: 09/222,281

[22] Filed: Dec. 28, 1998

[51] Int. Cl.[7] ..... A45D 40/06; A45D 40/22

[52] U.S. Cl. ..... 401/60; 401/59

[58] Field of Search ..... 401/60, 59

[56] References Cited

U.S. PATENT DOCUMENTS

| | | | |
|---|---|---|---|
| 1,987,473 | 1/1935 | Fullmer | 401/59 |
| 4,973,178 | 11/1990 | Kakuta et al. | 401/60 X |
| 5,833,962 | 11/1998 | Chen | 401/59 |
| 5,890,826 | 4/1999 | Kim | 401/60 |

*Primary Examiner*—Henry J. Recla
*Assistant Examiner*—Kathleen J. Prunner
*Attorney, Agent, or Firm*—Harrison & Egbert

[57] ABSTRACT

An improved lipstick case having an outer tube with a spiral trough formed thereon, an inner tube fastened rotatably within the outer tube and having a handle at a bottom end thereof, a tube sheath affixed at the top end of the inner tube, an end cover pivotally connected at a top end of the inner tube and pivotally connected to the tube sheath, a revolve tube received within the inner tube and having a top end with an oblique open edge, a lipstick, and a slide tube seat receiving the lipstick and received within the revolve tube. The revolve tube has a vertical guide trough and a vertical slide trough. The inner tube also has a vertical slide trough. The slide tube seat has a pillar extending outwardly adjacent a bottom end of the slide tube seat. The pillar extends into the slide trough of the revolve tube, into the fixing slot of the vertical slide trough of the inner tube and into the spiral trough of the outer tube.

1 Claim, 9 Drawing Sheets

LIPSTICK CASE

FIELD OF THE INVENTION

The present invention relates generally to a lipstick case, and more particularly to an improved lipstick case.

BACKGROUND OF THE INVENTION

The conventional lipstick case has the slide tube seat engaged directly with the inner tube sheath which revolves for operating the slide tube seat up and down. However, the cover tube is provided separately.

Such construction as described above is defective in design.

The cover tube easily disappears once being separated, so that it loses its effective protection of the lipstick.

The revolving of the inner tube sheath, which operates the slide tube seat up and down does not have the function of holding its postion. Therefore, it causes the slide tube seat to retract while in use.

The protrusion of the slide tube seat has an improper length for fastening firmly within the inner tube sheath, so that it is easy to shake and destroy the lipstick.

SUMMARY OF THE INVENTION

The primary objective of the present invention is to provide an improved lipstick case which is free from the drawbacks of revolving type prior art lipstick cases.

In the present invention the guide slide trough of the revolve tube extends along an angled slot together with the horizontal push trough extended upward by a vertical slide trough which are matched with the slide trough of the inner tube, the fixing slot, and a protrusion. In addition, there is an end cover pivoted in one with a tube sheath, and the outer tube is provided with an inner spiral trough.

The objective, features, functions and advantages of the present invention will be more readily understood upon a thoughtful deliberation of the following detailed description of the present invention with reference to the accompanying drawings.

DETAILED DESCRIPTION OF THE INVENTION

Figure 1:
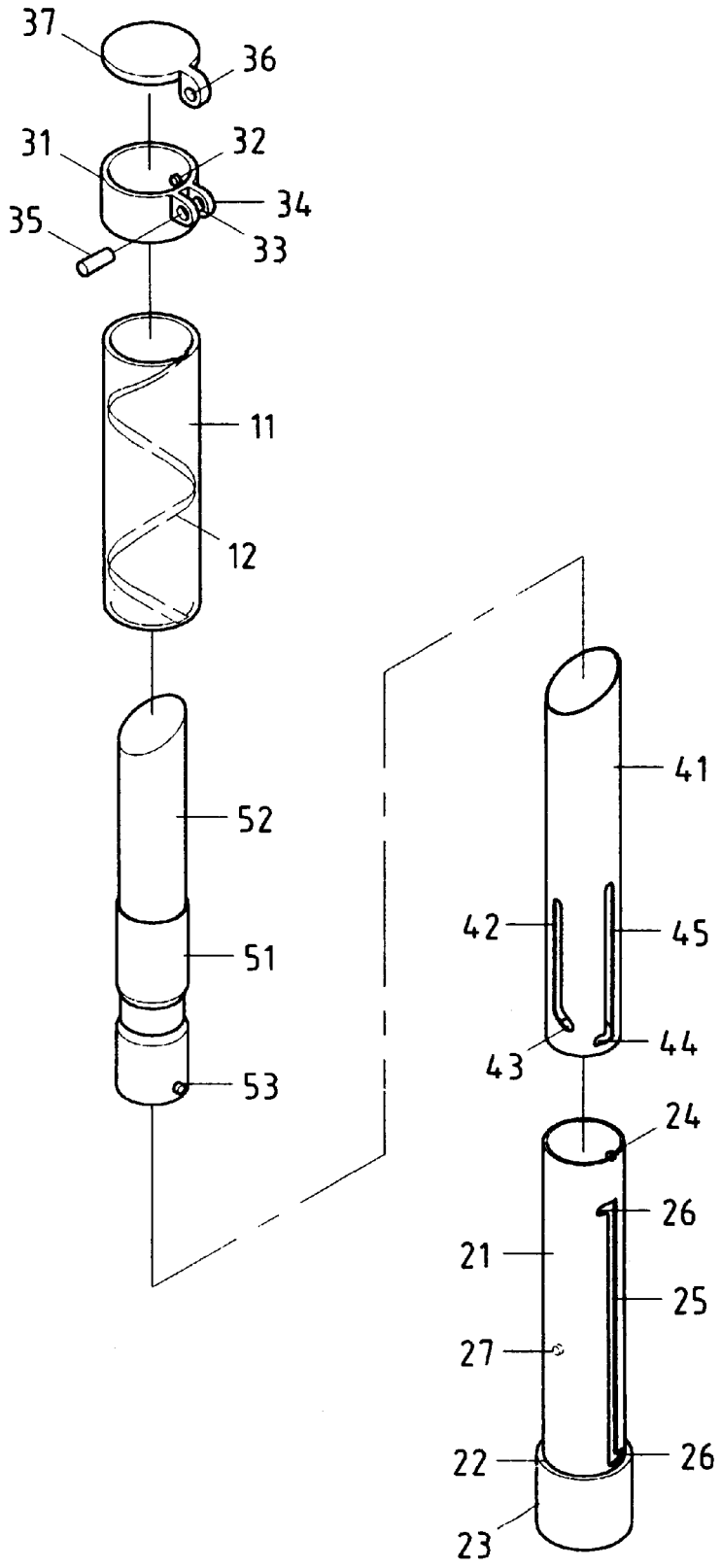
FIG. 1 shows an exploded view of the present invention.
Figure 2:
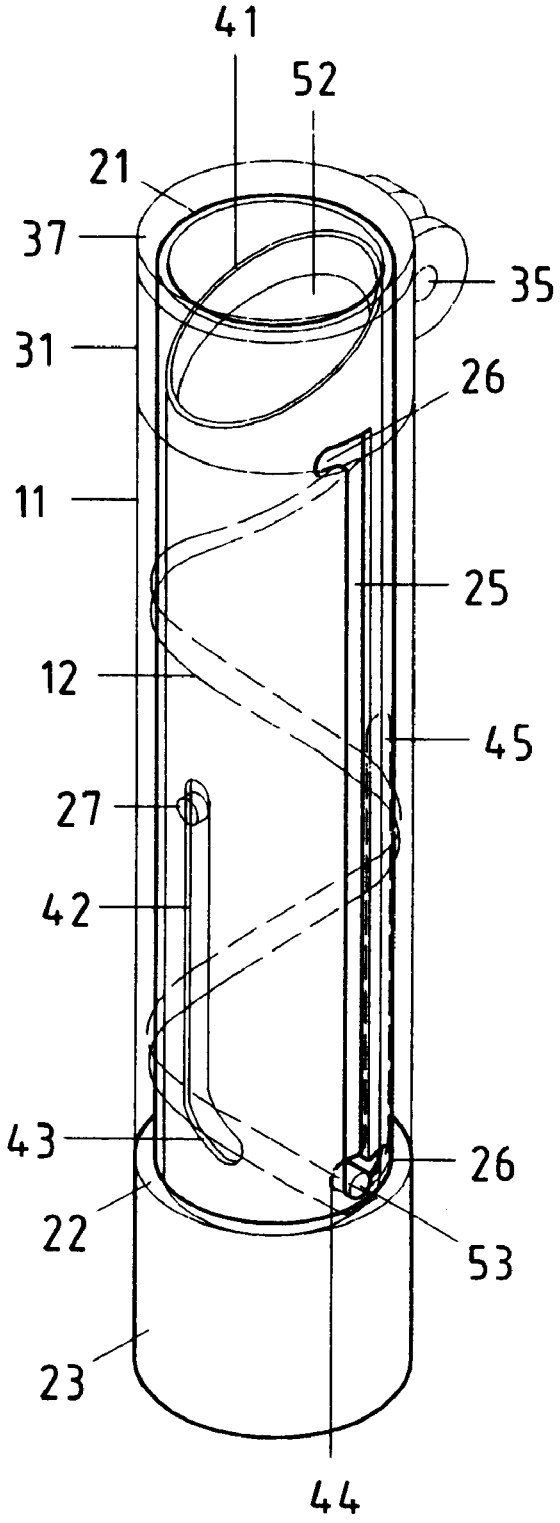
FIG. 2 shows a perspective view of the present invention.

As shown in FIGS. 1 and 2, an improved lipstick case embodied in the present invention is composed of an outer tube 11, an inner tube 21, a tube sheath 31, a revolve tube 41, and a slide tube seat 51.

The outer tube 11 is provided with an inner spiral trough 12 having both ends extended to the ends of the outer tube 11.

The inner tube 21 is rotatably fastened in the outer tube 11. The end of inner tube 21 forms a handle 23 using a step ring 22, and the top end of inner tube 21 forms an indentation 24 at one side. The inner tube 21 that is fastened in the outer tube 11 has a vertical limit slide trough 25 on the tube wall. Both ends of the vertical slide trough 25 are provided each with a fixing slot 26, in which the extend direction of its bending is opposite to the extend direction of the spiral trough 12. The interior of the inner tube 21 is provided with a protrusion 27.

The tube sheath 31 is fastened on the top end of the inner tube 21. The tube sheath 31 is provided with an inner pin 32 for wedging fixedly into the indentation 24, and further matches with the handle 23 for fixing the outer tube 11 in place. The tube sheath 31 is further provided with a pair of holes 33 of protruding ears 34 for letting the shaft 35 to pivot the flange ring 36 of the end cover 37.

The revolve tube 41 is engaged inside the inner tube 21. The top end of the revolve tube 41 forms an oblique open edge, and the bottom end is provided with vertical guide trough 42 and horizontal push trough 44 which corresponds to the protrusion 27 and the slide trough 25 of the inner tube 21. The guide trough 42 is extended through an angled slot 43 at one end section, and the horizontal push trough 44 is extended upward along a vertical slide trough 45.

Figure 3:
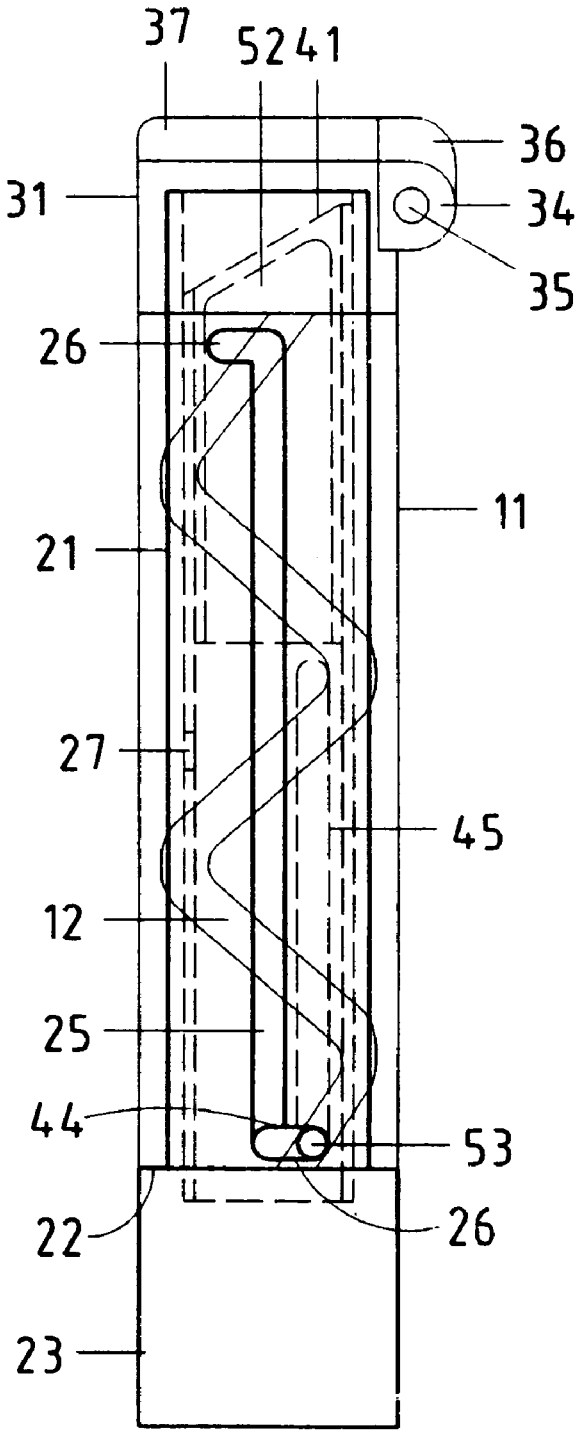
FIG. 3 shows a sectional view of the present invention.

The slide tube seat 51 receives the lipstick 52 an at upper section where the whole body is put into the revolve tube 41. The bottom section of slide tube seat 51 is provided with a pillar 53 which passes in sequence through the vertical slide trough 45 of the revolve tube 41 and the bottom end fixing slots 26 of slide trough 25 of the inner tube 21, then it is fixed to the inside of the spiral trough 12 of the outer tube 11 (as shown in FIG. 3).

Therefore the elements of construction described above allow the present invention to connect the pivoting in the end cover 37 which is easily retracted or extracted in place, and to improve the revolve tube 41 protection.

The present invention has advantages over the prior art. Such advantages are described hereinafter.

Figure 4:
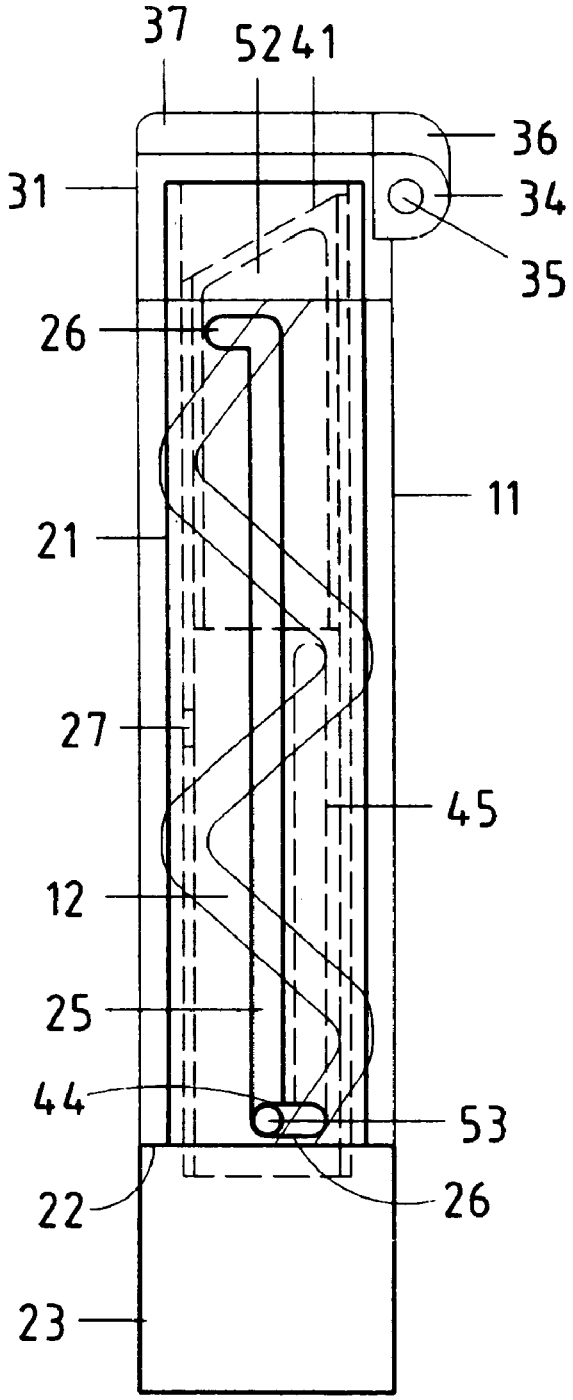
FIG. 4 shows another sectional view of the present invention.
Figure 5:
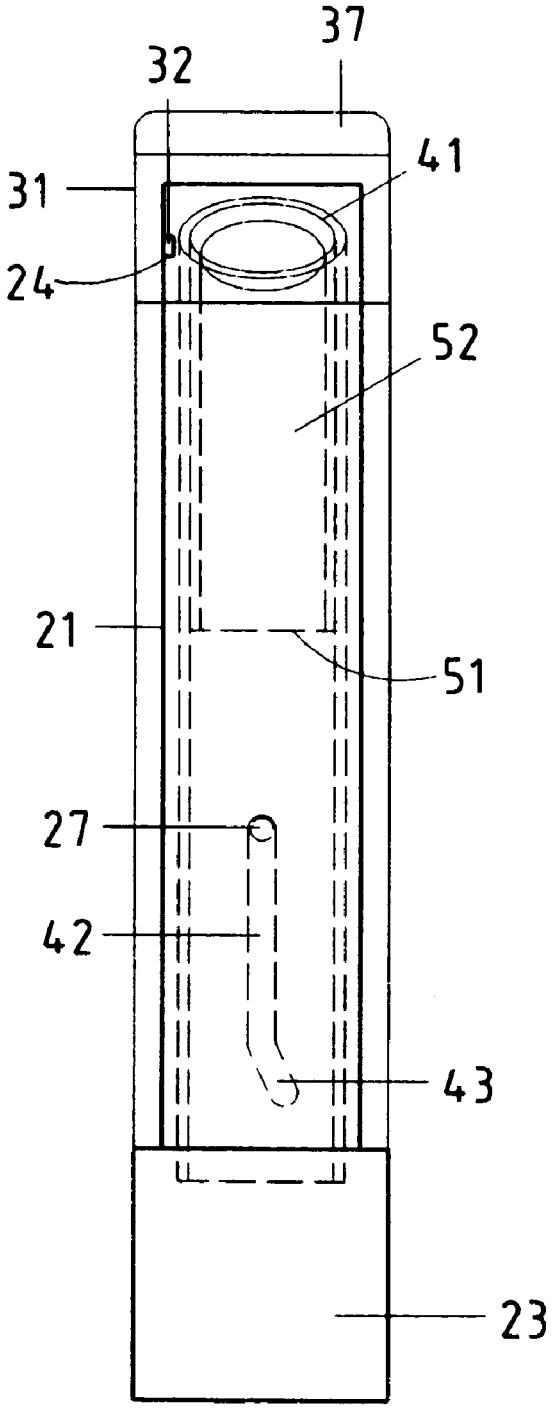
FIG. 5 shows a front view of the present invention.
Figure 6:
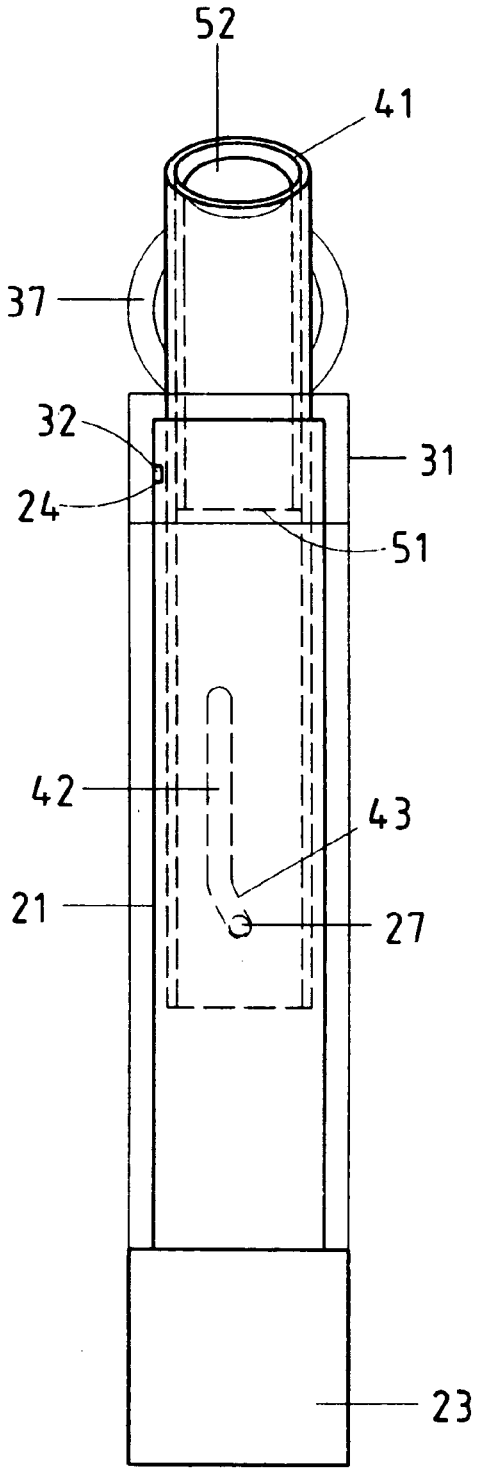
FIG. 6 shows another front view of the present invention.
Figure 7:
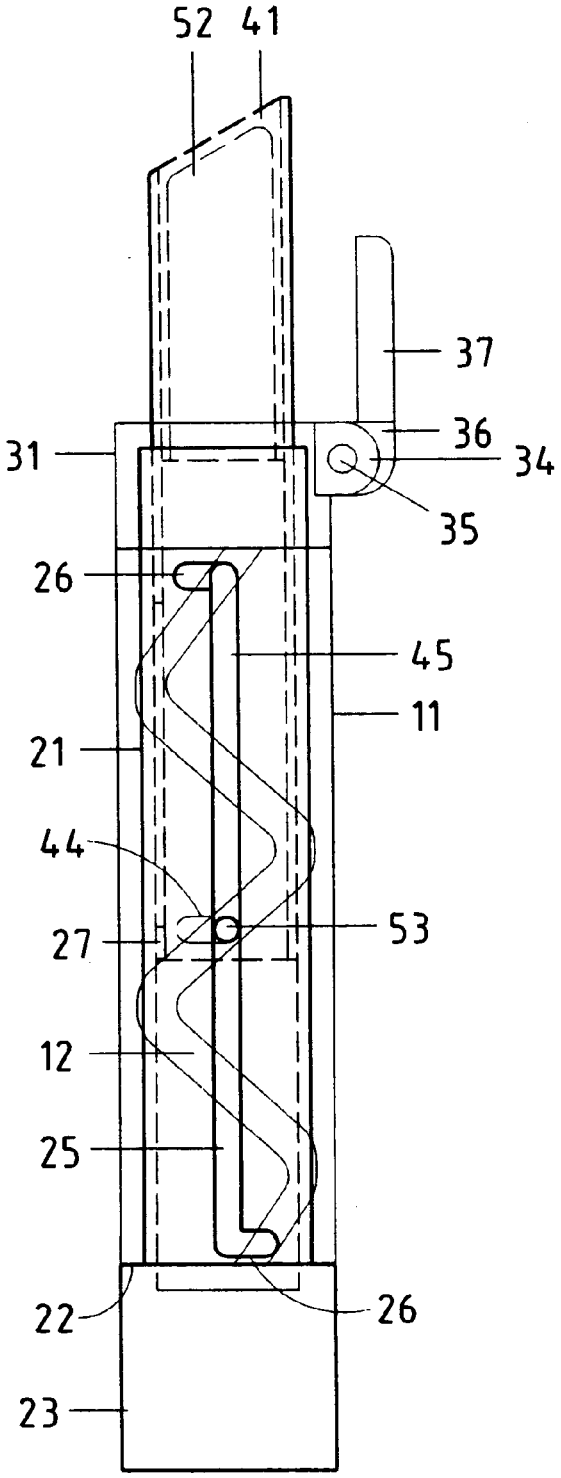
FIG. 7 shows a side view of the present invention.
Figure 8:
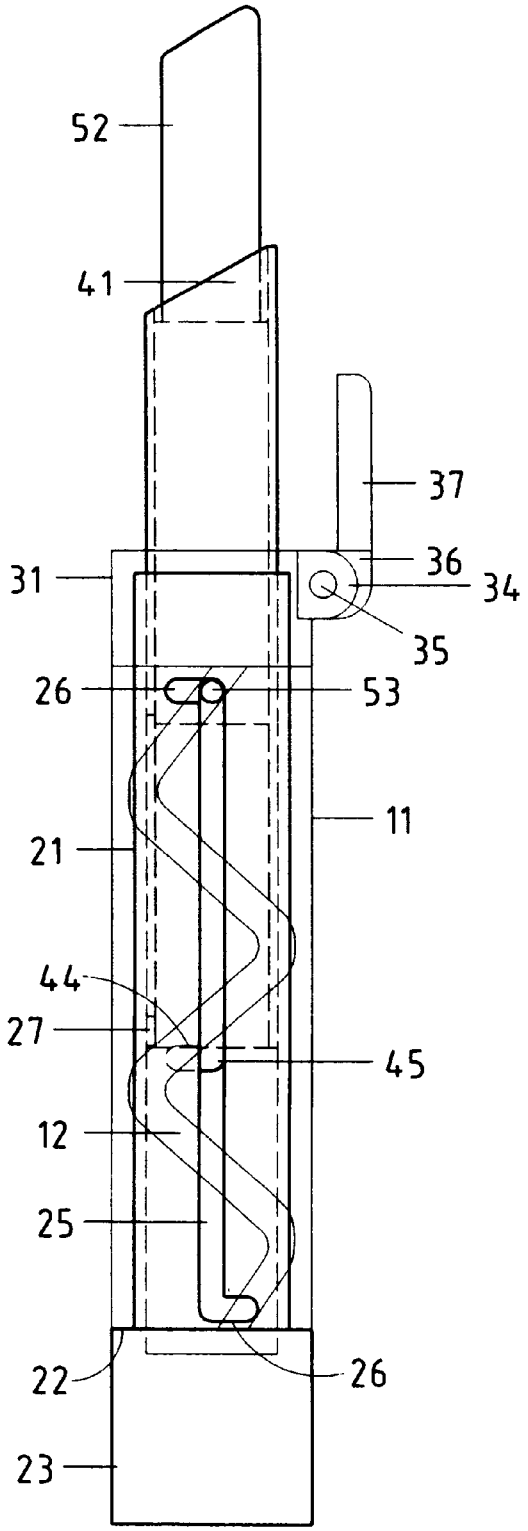
FIG. 8 shows another side view of the present invention.
Figure 9:
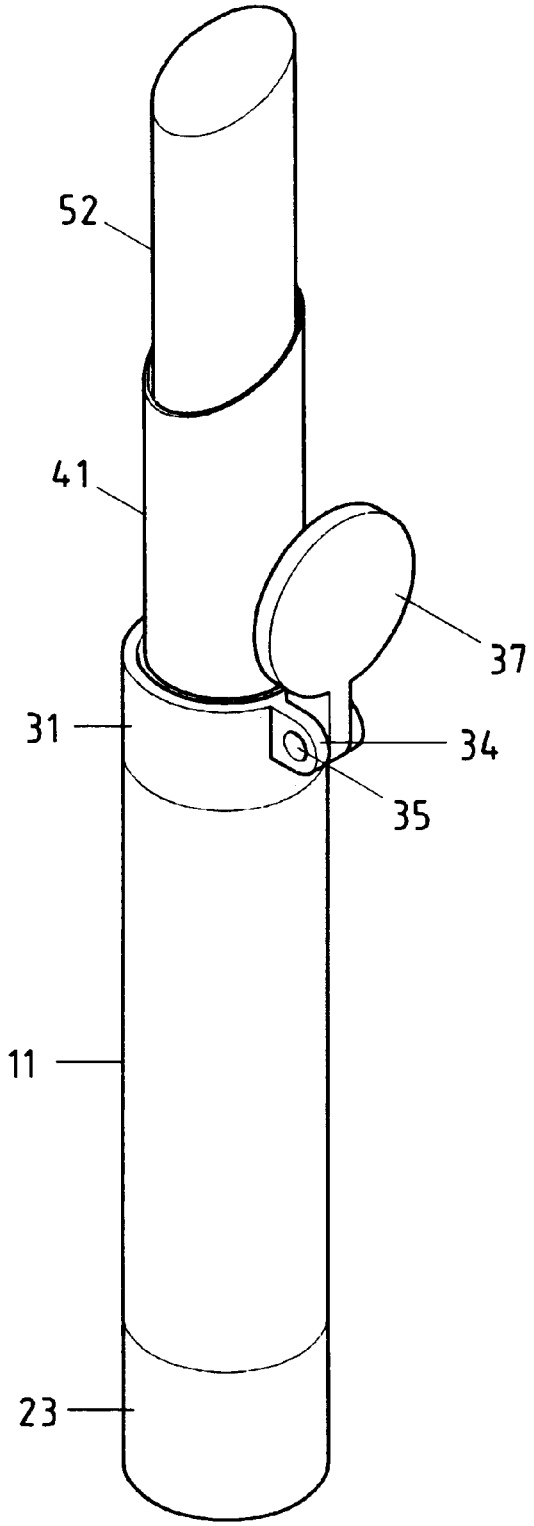
FIG. 9 shows a schematic view of the present invention.

In the present invention, the outer tube 11 revolves corresponding to the inner tube 21, so that the spiral trough 12 drives the pillar 53 of slide tube seat 51. In addition, the fixing slot 26 and vertical slide trough 45 cause slide trough 25 and horizontal push trough 44 to remove the retracted lipstick from the fixed position (as shown in FIGS. 4 and 5). Then the spiral trough 12 drives pillar 53 to move upward along the slide trough 25 and further drives the revolve tube 41 and the slide tube seat 51 to lift up. Moreover, when the guide trough 42 of the revolve tube 41 moves upward at the same time and is limited by the protrusion 27 of the inner tube 21, then the protrusion 27 moves to the rotate guide trough 43 of the end guide trough 42 (as shown in FIGS. 6 and 7). Thus, the revolve tube 41 makes the vertical slide trough 45 correspond to the pillar 53 for no further extention. However, the pillar 53 is still moving upward along the slide trough 25 and vertical slide trough 45 (as shown in FIGS. 8 and 9). Therefore the slide tube seat 51 moves up relatively on the revolve tube 41, and the spiral trough 12 drives the pillar 53 for inserting into the fixing slot 26 and is fixed in place by the protrusion. For retracting, it just operates by turning in the opposite direction. The revolve tube 41 increases the depth engaged mutually between the slide tube seat 51 and the inner tube 21 for improving the stability of the protrusion structure of lipstick case, and the revolve tube 41 does further to achieve the protection of the lipstick when extended. In addition, the end cover 37 is pivoted on the lipstick case. While the revolve tube 41 is lifting up, the end cover 37 can be opened. Such operation is absolutely convenient in use and prevents disappearance of the end cover.

The embodiment of the present invention described above is to be deemed in all respects as being merely illustrative and not restrictive. Accordingly, the present invention may be embodied in other specific forms without deviating from the spirit thereof. The present invention is therefore to be limited only by the scope of the following appended claim.

I claim:

1. An improved lipstick case comprising:

an outer tube having an interior surface, said interior surface having a spiral trough formed thereon and extending from one end of said outer tube to another end of said outer tube;

an inner tube fastened rotatably within said outer tube, said inner tube having a handle at a bottom end thereof, said handle defining a stop ring, said inner tube having an indentation at a top end and at a side thereof, said inner tube having a vertical slide trough formed through a wall of said inner tube, said vertical slide trough having a first fixing slot at one end thereof and a second fixing slot formed at an opposite end thereof, said first and second fixing slots extending transverse to said vertical slide trough from opposite sides respectively of said vertical slide trough, said inner tube having a protrusion extending from said wall into an interior of said inner tube;

a tube sheath affixed at said top end of said inner tube, said tube sheath having an inner pin engaging said indentation of said inner tube, said outer tube being positioned over said inner tube between said tube sheath and said stop ring of said handle, said tube sheath having a pair of holes formed respectively on a pair of ears extending outwardly of an outer surface of said tube sheath, said pair of holes receiving a shaft therein;

an end cover having a flange ring affixed thereto, said flange ring being pivotally connected to said shaft such that said end cover is pivotally positioned over said top end of said inner tube;

a revolve tube received within said inner tube, said revolve tube having a top end with an oblique open edge, said revolve tube having a vertical guide trough and a vertical slide trough formed in a wall thereof, said slide trough having a horizontal push trough at an end of said slide trough adjacent a bottom end of said revolve tube, said guide trough receiving said protrusion of said inner tube therein, said slide trough of said revolve tube being aligned with said vertical slide trough of said inner tube, said guide trough having an angled slot at an end thereof;

a lipstick; and a slide tube seat receiving said lipstick at an upper end thereof, said slide tube seat and said lipstick being received within said revolve tube, said slide tube seat having a pillar extending outwardly therefrom adjacent a bottom of said slide tube seat, said pillar extending into said slide trough of said revolve tube and into said fixing slot of said vertical slide trough of said inner tube and into said spiral trough of said outer tube.

* * * * *